US009803263B2

(12) United States Patent
Berglund

(10) Patent No.: US 9,803,263 B2
(45) Date of Patent: Oct. 31, 2017

(54) METHOD FOR MANUFACTURING A WEAR RESISTANT COMPONENT

(71) Applicant: SANDVIK INTELLECTUAL PROPERTY AB, Sandviken (SE)

(72) Inventor: Tomas Berglund, Falun (SE)

(73) Assignee: Sandvik Intellectual Property AB, Sanviken (SE)

( * ) Notice: Subject to any disclaimer, the term of this patent is extended or adjusted under 35 U.S.C. 154(b) by 55 days.

(21) Appl. No.: 14/427,583

(22) PCT Filed: Sep. 11, 2013

(86) PCT No.: PCT/EP2013/068833
§ 371 (c)(1),
(2) Date: Mar. 11, 2015

(87) PCT Pub. No.: WO2014/041027
PCT Pub. Date: Mar. 20, 2014

(65) Prior Publication Data

US 2015/0247219 A1 Sep. 3, 2015

(30) Foreign Application Priority Data

Sep. 12, 2012 (EP) ..... 12184048

(51) Int. Cl.
*C22C 1/05* (2006.01)
*C22C 29/08* (2006.01)
(Continued)

(52) U.S. Cl.
CPC ..... *C22C 1/05* (2013.01); *B22F 3/15* (2013.01); *C22C 29/08* (2013.01); *C22C 32/0052* (2013.01); *B22F 2998/10* (2013.01)

(58) Field of Classification Search
CPC ... B22F 3/15; C22C 1/05; C22C 29/08; C22C 32/0052
See application file for complete search history.

(56) References Cited

U.S. PATENT DOCUMENTS 6,479,014 B1 * 11/2002 Wu ..... B23D 61/028 148/425
7,713,468 B2 5/2010 Persson et al.
(Continued)

FOREIGN PATENT DOCUMENTS

| | | | |
|---|---|---|---|
| CN | 101195163 | A | 6/2008 |
| EP | 0763605 | A2 | 3/1997 |
| JP | H01-205048 | A | 8/1989 |

OTHER PUBLICATIONS

Lou, D. et al. "Interactions between tungsten carbide (WC) particulates and metal matrix in WC-reinforced composites." Materials Science and Engineering. (2003). p. 155-162.*
(Continued)

*Primary Examiner* — Colleen P Dunn
*Assistant Examiner* — Nicholas Wang
(74) *Attorney, Agent, or Firm* — Morgan, Lewis & Bockius LLP

(57) ABSTRACT

A method for manufacturing a wear resistant component, includes the steps of: providing a mould defining at least a portion of the component; providing a powder mixture comprising a first powder of tungsten carbide and a second powder of a cobalt-based alloy, wherein the powder mixture comprises 30-70 vol % of the first powder of tungsten carbide and 70-30 vol % of the second powder of the cobalt-based alloy and the second powder of cobalt-based alloy comprises 20-35 wt % Cr, 0-20 wt % W, 0-15 wt % Mo, 0-10 wt % Fe, 0.05-4 wt % C and balance Co, wherein the amounts of W and Mo fulfills the requirement 4<W+Mo<20; filling the mould with the powder mixture; and subjecting the mould to Hot Isostatic Pressing (HIP) at a predetermined temperature, a predetermined isostatic pressure and for a predetermined time so that the particles of the powder mixture bond metallurgically to each other.

38 Claims, 2 Drawing Sheets

(51) Int. Cl.
*C22C 32/00* (2006.01)
*B22F 3/15* (2006.01)

(56) References Cited

U.S. PATENT DOCUMENTS

2005/0117984 A1* 6/2005 Eason ..... B22F 3/15 408/144
2010/0116557 A1* 5/2010 Lockwood ..... C22C 29/08 175/393
2010/0230173 A1* 9/2010 Xia ..... E21B 10/50 175/374
2012/0040183 A1* 2/2012 Kelkar ..... B22F 3/1035 428/367
2012/0247028 A1* 10/2012 Konyashin ..... B23B 27/148 51/309
2012/0285293 A1* 11/2012 Mirchandani ..... C22C 29/00 75/230
2012/0318399 A1* 12/2012 Yao ..... C22C 19/07 138/145

OTHER PUBLICATIONS

Stellite (R) 21 alloy. Deloro Stellite. (2013). p. 1-2.*
Lou et al. "Interactions between tungsten carbide (WC) partiulates and metal matrix in WC-reinforced composites." Materials Science and Engineering. 2003. p. 155-162.*
Atkinson, H.V. et al. "Fundamental aspects of hot isostatic pressing: an overview" 2000. (31A). p. 2981-3000.*
D. Lou et al: "Interactions between tungsten carbide (WC) particulates and metal matrix in WC-reinforced composites", Materials Science and Engineering A, vol. A340, 2003, pp. 155-162.
Translation of Notification of the Second Office Action dated Feb. 4, 2017, for corresponding Chinese Patent Application No. 201380047279.2.

* cited by examiner

METHOD FOR MANUFACTURING A WEAR RESISTANT COMPONENT

RELATED APPLICATION DATA

This application is a §371 National Stage Application of PCT International Application No. PCT/EP2013/068833 filed Sep. 11, 2013, claiming priority of EP Application No. 12184048.2, filed Sep. 12, 2012.

TECHNICAL FIELD

The present invention relates to a method for manufacturing a wear resistant component and a wear resistant component obtained by the inventive method.

BACKGROUND ART

Metal Matrix Composites (MMC) is a material which comprises hard particles such as nitrides, carbides, borides and oxides embedded in a ductile metal phase. Typically, the MMC-component is manufactured by subjecting a powder blend of hard particles and a metal alloy powder to Hot Isostatic Pressing (HIP). The properties of the MMC-materials can be tailored for specific applications by adjusting the proportion of the volume fraction of hard particles in relation to the volume fraction of the ductile metal phase. MMC-materials are often used as a wear resistant material in various applications, for example mining. The primary use of MMC as a wear resistant material is for protecting against abrasive wear, i.e. wear from particles or bodies that slide over the surface of a component. Under abrasive conditions the wear resistance of known MMC-material is typically improved by increasing the volume fraction of hard particles in the material.

A problem associated with known MMC materials is their relatively low resistance to erosion.

Erosion is common wear mechanism in which a stream of particles, such as a slurry of sand and water, hits the surface of a component and strikes out small pieces of material from the component. Under conditions where erosion is the dominating wear mechanism, the wear is more complex than under conditions where abrasion dominates. This is to a certain extent due to that the erosion rate of the material in the component is dependent on the impinging angle of the erosive material. In general, the ductile metal phase performs better at high impingement angles whilst the hard and relatively brittle hard particles perform better at lower angles. Hence, the resistance to erosion depends on the individual properties of the hard phase and the ductile phase as well as on the combination of the two phases.

Merely increasing the volume fraction of hard particles in the precursor powder that the component is made of does therefore not necessarily result in reduced erosive wear of the component. An increase of the hard phase would lead to less ductile phase in the component and hence lower erosion resistance at high impingement angles.

A further aspect is that an increase of the volume fraction of hard particles in the precursor powder makes the powder more difficult to mix to a homogenous blend in which a large proportion of the hard particles are surrounded by ductile metal particles. As a result thereof a large portion of the hard particles could be in contact with each other which in turn could lead to networks of interconnecting carbides, thereby making the MMC material brittle and vulnerable to erosion.

Attempts have been made in the past to achieve wear resistant claddings on components by using laser beams to melt a powder of hard particles and cobalt based alloy powders onto the surface of the component. [T. R Tucker et al, Thin Solid Films 118 (1984) 73-84 "Laser-processed composite metal cladding for slurry erosion resistance]. However, the laser based method produces molten phases and during solidification, segregation of alloy elements results in inhomogeneous and brittle areas in the cladding layer. The method is further expensive, time consuming, limited with regards to coating thickness and unsuitable for producing large wear resistant components.

Hence, it is an object of the present invention to present an improved method of manufacturing a wear resistant component. In particular it is an object of the present invention to present a method for manufacturing components with improved resistance to erosive wear. It is also an object of the present invention to present a cost effective method which results in wear resistant components having a homogenous, i.e. isotropic structure. Yet a further object of the present invention is to achieve a component which has high resistance to wear under erosive conditions

SUMMARY OF THE INVENTION

According to a first aspect of the invention at least one of the above objects is achieved by a method for manufacturing an wear resistant component comprising the steps:

- providing a mould defining at least a portion of the component;
- providing a powder mixture comprising a first powder of tungsten carbide and a second powder of a cobalt-based alloy, wherein the powder mixture comprises 30-70 vol % of the first powder of tungsten carbide and 70-30 vol % of the second powder of the cobalt-based alloy and wherein the second powder of cobalt-based alloy comprises 20-35 wt % Cr, 0-20 wt % W, 0-15 wt % Mo, 0-10 wt % Fe, 0.05-4 wt % C and balance Co; whereby the amounts of W and Mo fulfills the requirement $4<W+Mo<20$;
- filling the mould with the powder mixture;
- subjecting the mould to Hot Isostatic Pressing (HIP) at a predetermined temperature, a predetermined isostatic pressure and for a predetermined time so that the particles of the powder mixture bond metallurgical to each other with no residual porosity between them.

A HIP:ed component manufactured from the inventive powder mixture exhibits very high resistance to erosion and also to abrasive wear. The good wear resistance depends in part on the relatively large tungsten carbide particles from the first powder that are distributed in the component. However, it is believed that the high wear resistance, and in particular the resistance to erosive wear further is a result of both the deformation hardening properties of the cobalt base matrix and an unexpected amount of small hard carbides, i.e. in a size of 1-4 μm, that forms in the matrix of the component during HIP:ing by reaction between the WC-particles of the first powder and the alloy elements of cobalt based alloy powder. The presence of the additional small carbides in the matrix protect the cobalt base alloy matrix from erosion due to abrasive media hitting the MMC material at both high and low impingement angles.

This makes the inventive method very suitable for the manufacturing of components that are subjected to erosion, such as components that are used in the mining industry. A further advantage of the inventive method is that the produced component has isotropic microstructure and isotropic properties. The isotropic nature of the produced component is a result of the HIP process which takes place at a temperature below the melting points of the materials which makes up the component. Due to the absence of molten phases during HIP, inhomogeneity due to segregation of alloy elements or differences in density between tungsten carbide particles and metal alloys is avoided.

DEFINITIONS

Figure 1:
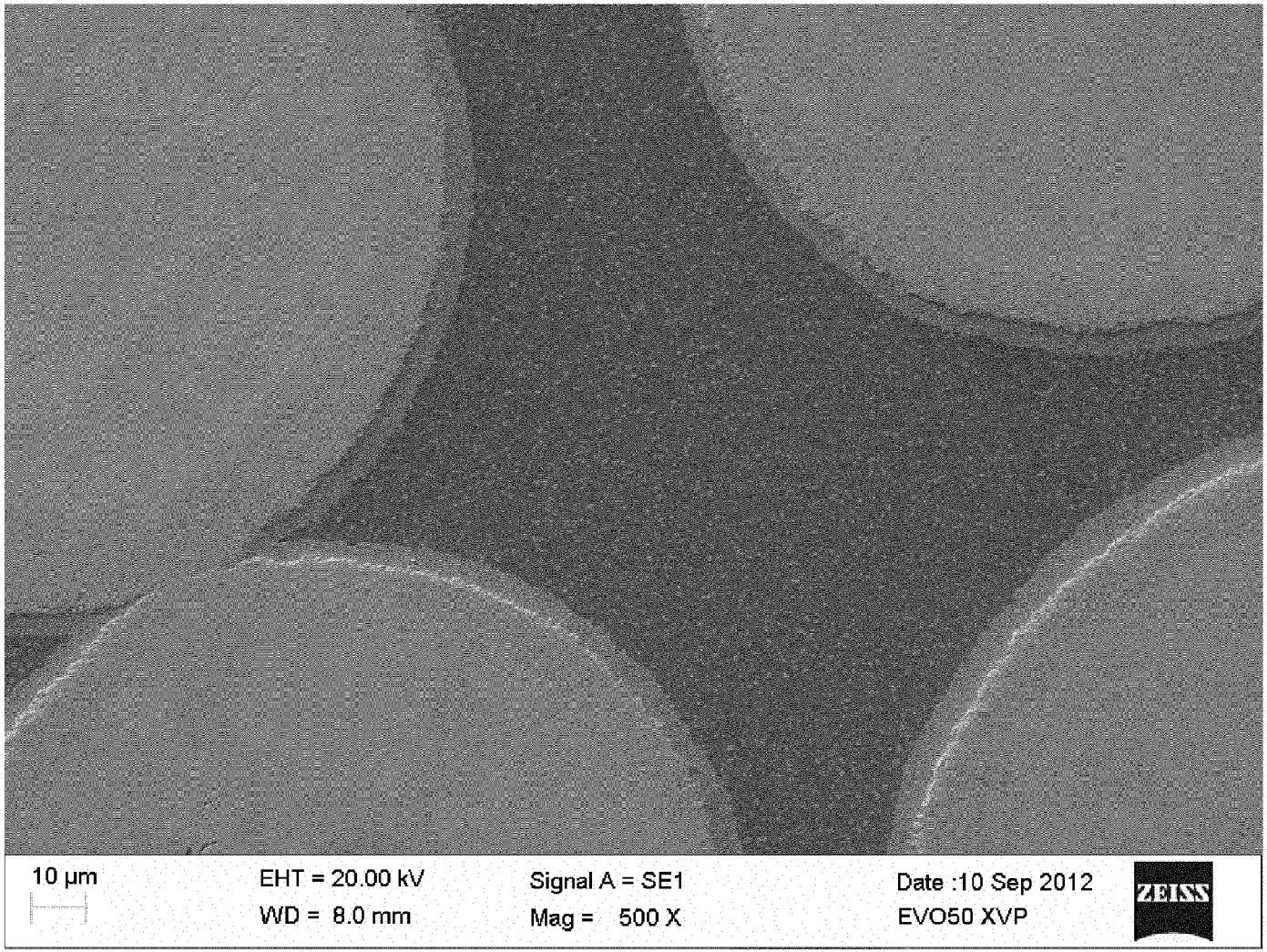
FIG. 1: A SEM image in 500× magnification of an MMC material manufactured from by the inventive method according to a first preferred embodiment.

By "powder" is meant a volume of small particles. i.e. having a mean size less than 500 μm.

By "powder mixture" is meant a volume comprising particles of at least two different compositions, i.e. particles of a material of a first composition and particles of a material of a second composition. In the powder mixture, the particles of different materials are blended homogenously.

By "isotropic microstructure" and "isotropic properties" is meant that the entire manufactured component has the same microstructure and properties and that the microstructure and the properties are the same in all directions of the component.

By "WC" is meant either pure tungsten carbide or cast eutectic carbide (WC/W2C).

DETAILED DESCRIPTION OF THE INVENTION

In a first step of the inventive method, a mould is provided. The mould, which also may be referred to as capsule or form, defines at least a portion of the shape or contour of the final component. The mould is typically manufactured from steel sheets, such as low-carbon steel, that are welded together. The mould may define the entire component. The mould may also define a portion of the component. This is advantageous when a core of, for example construction steel, is to be provided with a wear resistant cladding. In this case the mould defines one part of the component, i.e. the cladding and the core defines the other part of the component. The component is for example a component for mining operations or ore- or slurry handling. For example, a crusher tooth or a slurry handling pipe. However, it is evident that the component may be any type of wear resistant component.

In a second step, an inventive powder mixture is provided.

The inventive powder mixture comprises a first powder which is a powder of tungsten carbide particles (WC), such powders are commercially available, for example by the companies HC Starck and Treilbacher. In the final HIP:ed component, the tungsten carbide powder provides a hard abrasion resistant phase which protects the component from erosive material which hits the component at low impingement angles.

The inventive powder mixture further comprises a second powder of a cobalt based alloy. In the final component the second powder of the cobalt based alloy makes up the matrix, i.e. the material which surrounds and embeds the tungsten carbide particles of the first powder. Several types of cobalt based alloys could be used in the inventive powder mixture, however, the cobalt alloy should contain carbide forming elements such as chromium, tungsten or molybdenum. The cobalt based alloy may for example be any alloy similar to the type Stellite™ which is commercially available for example Stellite no 1 or Stellite no 6.

The cobalt base alloy is ductile in comparison to the hard particles of tungsten carbides of the first powder of the inventive powder mixture. In the resulting MMC component this provides for low brittleness and high toughness.

However, the main advantage of using cobalt based alloys in the inventive powder mixture is that these alloys have low stacking fault energy which leads to a suitable deformation hardening behavior of the alloy. This is believed to be one reason for cobalt based alloys good resistance to erosion at high impinging angles of the erosive media.

According to a first embodiment of the invention, the inventive powder mixture comprises a powder of a cobalt based alloy which contains 20-35 wt % Cr, 0-20 wt % W, 0-15 wt % Mo, 0.5-4 wt % C, 0-10 wt % Fe and balance of Co and naturally occurring impurities. The amounts of W and Mo should be selected so that the expression $5<W+Mo<20$ is fulfilled.

Chromium is added for corrosion resistance and to ensure that hard chromium carbides are formed by reaction with the carbon in the alloy. Also tungsten and/or molybdenum are included in the alloy for carbide formation and solid solution strengthening.

The carbides, i.e. chromium carbides, tungsten carbides and/or molybdenum rich carbides increase the hardness of the ductile cobalt phase and thereby its wear resistance. However, too high amounts of the alloy elements Cr, W and Mo may lead to excessive amounts of carbide precipitation which reduces the ductility of the matrix. Therefore it is preferred that these elements are present in the following amounts in the cobalt alloy: Chromium: 20-35 wt % or 23-31 wt % or 25-30 wt % or 27-31 wt % or 27-29 wt %. Tungsten: 0-15 wt % or 10-20 wt % or 12-18 wt % or 13-16 wt %. Molybdenum: 10-15 wt %, 12-15 wt % or 13-14 wt %.

In the cobalt based alloy according to the first embodiment, the amount of carbon may be: 0.6-3.2 wt % or 0.7-3.0 wt % or 0.8-2.8 wt % or 1-2.6 wt % or 1.2 to 2.4 wt % or 1.4-2.2 wt % or 1.6-2.0 wt %.

The atomic weight of molybdenum is approximately one third of the atomic weight of tungsten which results in that one third of a weight unit of molybdenum can produce the same amount of carbides as one whole weight unit of tungsten. In comparison to an alloy comprising tungsten, the use of molybdenum therefore reduces the total cost of the powder mixture since less carbide forming material is used. Molybdenum may further increase corrosion resistance and abrasion resistance.

Iron is added to stabilize the FCC crystal structure of the alloy and thus increases the deformation resistance of the alloy. However, too high amounts of iron may affect mechanical, corrosive and tribological properties negatively. Iron should therefore be present in the following amounts in the cobalt alloy: 0-10 wt % or 1-8 wt % or 1-4 wt % or 3-6 wt %

As will be described more in detail under the "Example section" very good resistance to erosion and also to abrasion has been observed in HIP:ed MMC components that comprises a cobalt based alloy according to the first embodiment of the invention. It is believed that the good erosion resistance depend partly on the deformation hardening properties of the cobalt based alloy matrix but also on the presence of an unexpected large amounts of small carbides that forms in the cobalt base alloy matrix during HIP due to reaction between the tungsten carbide particles in the first powder and the alloy elements Cr, W and/or molybdenum in the matrix phase of the component. It is believed that the formation of the very large amount of the additional small carbides is related to the relatively high amounts of alloy elements present in the matrix.

According to an alternative of the first embodiment, the cobalt based alloy comprises 27-31 wt % Cr, 13-16 wt % W, 0 wt % Mo, 0-10 wt % Fe, 3.2-3.5 wt % C and balance Co and naturally occurring impurities.

According to an alternative of the first embodiment, the cobalt based alloy comprises 27-31 wt % Cr, 14-16 wt % W, 0 wt % Mo, 0-10 wt % Fe and 3.2-3.5 wt % C and balance Co and naturally occurring impurities According to an alternative of the first embodiment, the cobalt based alloy comprises 27 wt % Cr, 14 wt % W, 0 wt % Mo, 9 wt % Fe and 3.3% C and balance Co and naturally occurring impurities.

According to an alternative of the first embodiment, the cobalt based alloy comprises 27-31 wt % Cr, 13-16 wt % Mo, 0 wt % W, 0-10 wt % Fe, 3.2-3.5 wt % C and balance Co and naturally occurring impurities.

According to a second embodiment of the invention, the cobalt-based alloy comprises: 26-30 wt % Cr, 4-8 wt % Mo, 0-8 wt % W, 0.05-1.7 wt % C and balance Co, wherein the amounts of W and Mo preferably fulfills the requirement $4<W+Mo<16$.

An advantage with the cobalt based alloy according to the second embodiment of the invention is that it is relatively ductile in comparison to the cobalt alloys of the first embodiment of the invention. In a final HIP:ed component, the good ductility produces the effect that the cobalt alloy matrix can absorb the high stresses that are formed around the tungsten carbide particles when the component cools down from HIP temperature. This result in that no cracks form in, or close to, the matrix-carbide interface and the final component therefore receives a high wear resistance and increased operational life length. This is in particular advantageous in the production of components that are provided with a relatively thick cladding, such as a crusher tooth or slurry conveying pipe. During production of such components, large compressive stresses may be formed in the cladding as a result from differences in thermal expansion of the cladding and of the substrate. However, a cladding manufactured by cobalt based alloy according to the second embodiment of the present invention is ductile enough to absorb such stresses without cracking.

Also in the material according to the second embodiment, additional small carbides are formed by reaction between the tungsten particles and the alloy elements in the cobalt based alloy. These additional small carbides, although present in a relatively small amount, increases the wear resistance of the matrix. However, a further advantage of a material manufactured with a cobalt based matrix according to the second embodiment is that the relatively ductile matrix holds the tungsten particles in a manner which could be described as "sticky". This prevents the tungsten particles from being knocked out of the matrix by slurry particles during operation, which could be the case with a hard and rigid matrix.

In the cobalt based alloy according to the second embodiment, the amount of chromium may be 27-29 wt % or 26-28 wt %. The amount of molybdenum may be 5-7 wt %. The amount of tungsten may be 1-7 wt % or 2-6 wt % or 3-5 wt %. The amount of carbon may be 0.1-1.5 wt % or 0.2-1.4 wt % or 0.3-1.3 wt % or 0.4-1.2 wt % or 0.5-1.1 wt % or 0.6-1.0 wt % or 0.7 to –0.9 wt % or 0.6 to 0.8 wt %.

According to an alternative of the second embodiment, the cobalt based alloy comprises: 26-29 wt % Cr, 4.5-6 wt % Mo, 0.25-0.35 wt % C and balance Co.

An example of a cobalt based alloy according to the second embodiment of the invention is: 29 wt % Cr; 4.5 wt % Mo; 0.35 wt % C and balance Co.

In the inventive powder mixture, the amounts of the first and the second powders are selected such that the first, WC powder constitutes 30-70% of the total volume of the powder mixture and the second, cobalt-based alloy, powder constitutes 70-30% of the total volume of the powder mixture. For example, if 30% of the total volume of the powder mixture is constituted by WC, the remainder is 70% cobalt based alloy powder WC powder.

The amount of WC powder is important for achieving abrasion resistance but also for the formation of small carbide particles by reaction with the cobalt base alloy. The exact amounts of the first and the second powders are selected in view of the wear conditions of the application in question. However, with regard to the WC powder, the lowest acceptable amount is 30 vol % in order to achieve a significant resistance to abrasion and to ensure the formation of small carbide particles by reaction with the cobalt alloy. The amount of WC powder should not exceed 70 vol % since the resulting MMC material then may become to brittle. It is further difficult to blend or mix amounts of WC powder exceeding 70 vol % with the cobalt based powder to a degree where interconnection of the hard WC particles is minimized and a major portion of the WC particles are embedded in ductile cobalt powder.

The volume ratio may for example be 40 vol % WC-powder and 60 vol % cobalt powder, or 50 vol % WC-powder and 50 vol % of cobalt powder.

The size of the particles in the inventive powder mixture is 50-250 μm. In the final MMC component manufactured from the inventive powder mixture it is important that the fraction of interconnecting WC particles is minimized so that a majority of the WC particles are fully embedded, or surrounded, by the more ductile cobalt based alloy. Thereby ensuring a firm bond is achieved between the WC particles and the matrix and avoiding brittleness of the MMC.

To achieve this, the mean size of the cobalt particles in the second powder must be selected in dependency of the mean size of the WC-particles in the first powder and also in dependency of the volume fraction of the WC-particles in the powder mixture. For example In a mixture of 30 vol % WC-powder and 70 vol % cobalt base alloy the particle sizes may be 100-200 μm for the WC-powder and 45-95 μm for the matrix powder. In order to avoid problem with segregation in the final component, the mean size of the matrix powder should be less than ⅙ of the mean size of the WC-powder.

The WC particles may have spherical shape. This is advantageous since a spherical shape is very resistant to mechanical damage, for example from particles in a slurry that impinges on the WC-particles. Therefore, spherically shaped WC-particles increase the erosion resistance of an MMC component that is manufactured from the inventive powder mixture.

The WC-particles may also have facetted shape. Facetted particles are not as strong as spherically shaped particles since the edges of the facets may break when particles from a slurry particle hits the facetted WC-particle. However, facetted WC particles are available at lower cost than spherical WC particles and the use of facetted particles therefore reduces the overall cost of the MMC-component. It is of course possible to use both spherical and facetted WC particles in the inventive powder mixture in order to achieve a component of comparatively high wear resistant at a comparatively low cost.

Although the above description refers to a "first powder" and a "second powder" it is obvious that the inventive powder mixture also could comprise further powders, e.g. a "third powder" of a composition different from the compositions of the first and second powders.

In a third step, the inventive powder mixture is filled in the mould. Prior to filling the mould the first and second powders are blended to a homogenous powder mixture. Blending is important since the isotropic properties and microstructure of the final component is dependent on the homogeneity, or uniformity of the powder mixture.

After filling, the mould is evacuated and sealed. Typically is thereby a lid welded onto the mould, a vacuum is drawn through an opening in the lid and the lid is subsequently welded shut.

In a final step, the filled mould is subjected to Hot Isostatic Pressing (HIP) at a predetermined temperature, a predetermined isostatic pressure and a for a predetermined time so that the particles of the powder mixture bond metallurgical to each other. The form is thereby placed in a heatable pressure chamber, normally referred to as a Hot Isostatic Pressing-chamber (HIP-chamber).

The heating chamber is pressurized with gas, e.g. argon gas, to an isostatic pressure in excess of 500 bar. Typically the isostatic pressure is 900-1200 bar. The chamber is heated to a temperature which is below the melting point of cobalt based alloy powder. The closer to the melting point the temperature is, the higher is the risk for the formation of melted phase and unwanted streaks of brittle carbide networks. Therefore, the temperature should be as low as possible in the furnace during HIP:ing. However, at low temperatures the diffusion process slows down and the material will contain residual porosity and the metallurgical bond between the particles becomes weak. Therefore, the temperature is preferably 100-200° C. below the melting point of the cobalt based alloy, for example 900-1150° C., or 1000-1150° C. The filled mould is held in the heating chamber at the predetermined pressure and the predetermined temperature for a predetermined time period. The diffusion processes that take place between the powder particles during HIP:ing are time dependent so long times are preferred. However, too long times could lead to excessive WC dissolution. Preferable, the form should be HIP:ed for a time period of 0.5-3 hours, preferably 1-2 hours, most preferred 1 hour.

During HIP:ing the particles of the cobalt based alloy powder deform plastically and bond metallurgically through various diffusion processes to each other and the tungsten particles so that a dense, coherent component of diffusion bonded cobalt based alloy particles and tungsten carbide particles is formed. In metallurgic bonding, metallic surfaces bond together flawlessly with an interface that is free of defects such as oxides, inclusions or other contaminants.

After HIP:ing the form is stripped from the consolidated component. Alternatively, the form may be left on the component.

EXAMPLES

In the following, the invention will be further described with reference to concrete examples.

Example 1

A first comparative test was performed in order to examine the wear resistance of a component manufactured by the inventive method.

A test sample was prepared of the inventive powder mixture. This test sample was denominated IN1.

For comparison, two comparative test samples powder mixtures for known wear resistant MMC materials were prepared. These were denominated COM1 COM2.

The respective test samples had the following compositions and particle sizes:

IN1 contained 30 vol % WC-powder and 70 vol % of a powder of a cobalt base alloy having a composition of: 27 wt % Cr, 14 wt % W, 0 wt % Mo, 9 wt % Fe and 3.3% C and balance Co. The WC-powder had a mean size of 100-200 μm and the cobalt base alloy had a mean size of 45-95 μm.

COM 1 contained 30 vol % WC-powder and 70 vol % of a powder of the steel of the type APM 2311. The WC-powder had a mean size of 100-200 μm and the steel powder had a mean size of 45-95 μm.

COM 2 contained 30 vol % WC-powder and 70 vol % of a powder of the steel of the type APM 2723, similar to AISI M3:2. The WC-powder had a mean size of 100-200 μm and the steel powder had a mean size of 45-95 μm.

The powders of respective mixture were mixed to homogenous blend in a V-blender. Thereafter a mould, manufactured from steel sheets, was filled with the respective powder mixture and placed in a heatable pressure chamber, normally referred to as a Hot Isostatic Pressing-chamber (HIP-chamber).

The heating chamber was pressurized with argon gas to an isostatic pressure in excess of 500 bar. The chamber was heated to a temperature which was approximately 200° C. below the melting point of the respective metal phase of the samples and held at that temperature for 3 hours.

During HIP:ing of the samples the particles of the metallic matrix material deformed plastically and bonded metallurgically through various diffusion processes to each other and the WC-particles so that dense, coherent articles was formed. In metallurgic bonding, metallic surfaces bond together flawlessly with an interface that is free of defects such as oxides, inclusions or other contaminants.

After HIP:ing the moulds were striped from the samples and the samples were subjected to abrasion testing and erosion testing.

Firstly the samples were subjected to standardized "dry sand rubber wheel testing" to determine the resistance to abrasive wear. The samples were weighted before and after the dry sand a rubber wheel testing and with the aid of the density of each sample the volume loss of each sample was determined as a measure of abrasion. The volume loss in $mm^3$ of each sample is shown in column 2 of the table 1 below.

Secondly, the resistance to erosion was determined for each sample by "Slurry jet impingement erosion testing". This testing was performed by subjecting the sample with a jet of a slurry of water and sand. The slurry was ejected through a tube having a diameter of 4 mm and the water flow and the amount of sand in the water was selected such that the sand particles hit the surface with a velocity of 40 m/s and so that 950 grams of sand per minute hit the surface of the samples. Tests were performed at 30° impingement angle and 90° impingement angle.

The volume loss, in $mm^3$ of each sample was determined as above. The volume loss of each sample is shown in table 1 under column 3 (30° impingement angle) and column 4 (90° impingement angle).

TABLE 1

Results from abrasion and erosion testing

| Sample | Abrasion G65 | Erosion 90° | Erosion 30° |
|---|---|---|---|
| IN1 | 0.019852 | 2.8578 | 2.71 |
| COM 1 | 0.023244 | 4.9505 | 4.42 |
| COM 2 | 0.019481 | 3.9007 | 3.511 |

The sample that was manufactured from the inventive powder mixture was studied in a Carl Zeiss SEM.

The results from the testing shows that the inventive powder mixture yields a material which is has a resistance to abrasion which is in almost equal to the known materials, see COM 2 or even higher, see COM 1.

As is evident from columns 3 and 4, the MMC material from the inventive powder mixture exhibits higher erosion resistance than both comparative materials COM 1 and COM 2.

It is believed that the very good resistance to erosion that has been observed in the MMC materials that was manufactured from inventive powder mixture IN1, at least in part, is caused by the presence of large amounts of carbides in the ductile phase that constitutes the matrix of the MMC.

FIG. 1 shows a SEM image of a cross section of the sample that was manufactured from the inventive powder mixture IN1. The SEM image shows the large round WC-particles of the first powder and between the WC-particles a darker matrix with a large amount of small carbides in sizes ranging from 1-4 μm.

The image reveals the that more carbides than expected is formed in the HIP:ed MMC material of the inventive powder mixture.

The cobalt base alloy powder that was used in the inventive powder mixture IN1 contains approximately 50 vol % of carbides in the form of chromium carbides and WC. The cobalt base alloy was mixed with WC powder in a ratio of 70 vol % cobalt base alloy and 30 vol % WC powder. The total carbide content in the MMC material after HIP:ing was therefore expected to be approximately 35 vol %. However, measurements in the sample of MMC material show, surprisingly, that the carbide content was approximately 77 vol %, i.e. more than twice the expected amount. The reason for the unexpected high amount of carbides is believed to be caused by a reaction between the WC particles of the first powder and the alloy elements of the cobalt-base alloy. The reaction is believed to lead to transformation of WC from the large particles of the first powder, primarily to $W_2C$ but also to $M_6C$ (i.e. carbides of Cr and W) in the matrix. it is believed that the excess carbon that result from the reaction reacts with Cr in the alloy and form chromium rich carbides ($Cr_{23}C_6$, $Cr_7C_3$) in the matrix.

As can be seen in FIG. 1, the large volume fraction of small carbides in the matrix results in a short mean free path between the carbide particles. This is favorable for both abrasion resistance and erosion resistance since a large portion of an impinging abrasive media, such as sand slurry, will hit small hard carbide particles and not the ductile metallic material.

Example 2

In a second example the microstructure was investigated in a HIP:ed component which comprised tungsten carbide particles embedded in a matrix of the cobalt alloy according to the second embodiment.

A test sampled denominated IN2 was manufactured. The test sample IN2 contained 50 vol % WC-powder and 50 vol % of a powder of a cobalt base alloy having a composition of: 29 wt % Cr, 0 wt % W, 4.5 wt % Mo, 0 wt % Fe and 0.35% C and balance Co. The WC-powder had a mean size of 100-250 μm and the cobalt base alloy had a mean size of 45-95 μm.

As comparison a test sample IN3 was prepared from the cobalt based matrix according to the first embodiment sample IN3 was manufactured from powder mixtures containing 50 vol % WC-powder and 50 vol % of a powder of matrix alloy.

The cobalt base alloy of IN3 had the following composition: 27 wt % Cr, 14 wt % W, 0 wt % Mo, 9 wt % Fe and 3.3% C and balance Co.

Figure 2:
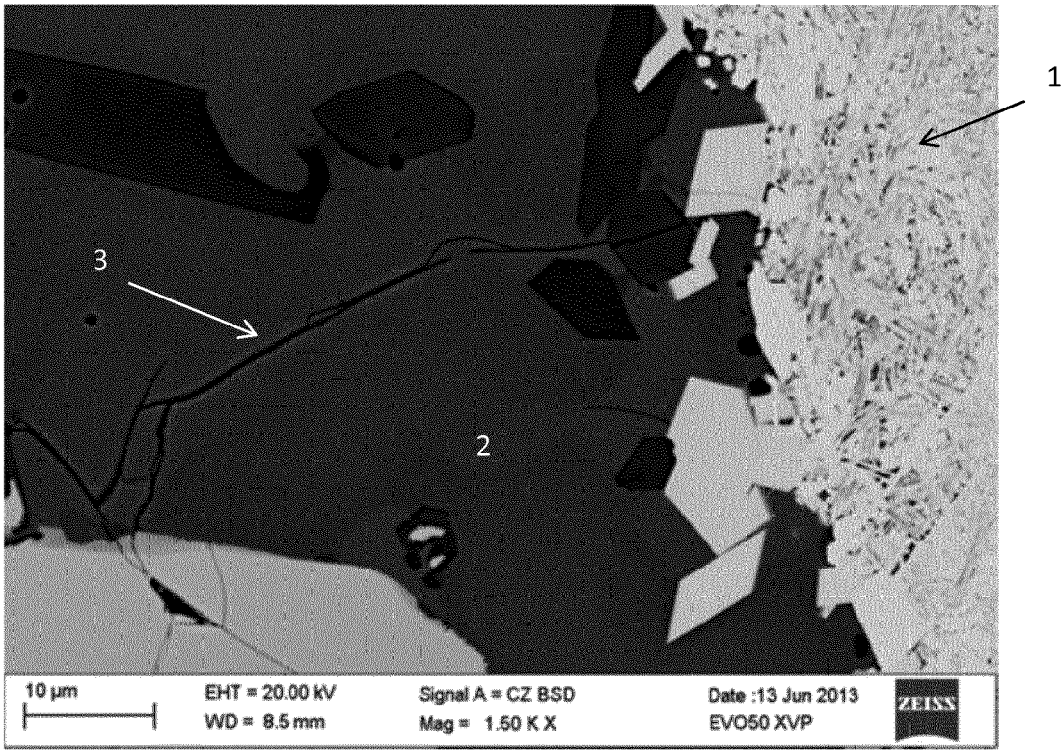
FIG. 2: A SEM image in 1.50K× magnification of the MMC material according to the first the preferred embodiment.

All the test samples were manufactured and prepared as described under Example 1 Both samples were thereafter investigated in the SEM in 1.50K magnification. FIG. 2 shows SEM photo of the sample from IN3 and FIG. 3 shows a sample of the SEM photo of the sample from IN2.

In the photos, the large white areas 1 are tungsten carbide particles and the dark areas 2 are cobalt alloy matrix. In FIG. 2, showing comparative sample IN3, it can be seen that the matrix 2 contains cracks 3 which propagate from the tungsten carbide particle. In FIG. 3 on the other hand no cracks can be observed. The cracks in the material of FIG. 2 are believed to have been formed during cooling of the component. During the HIP process, the component is heated to a temperature close to 1200° C. When the component cools down, the matrix and the carbides contracts differently due to differences in the coefficient of thermal expansion. This in turn, creates tensile stresses around the tungsten carbide particles. In FIG. 2 it can be seen that the matrix of the sample contains high amounts of tungsten and carbide. This makes the matrix very hard and promotes the formation of so high tensile stresses that cracks form in the matrix.

Figure 3:
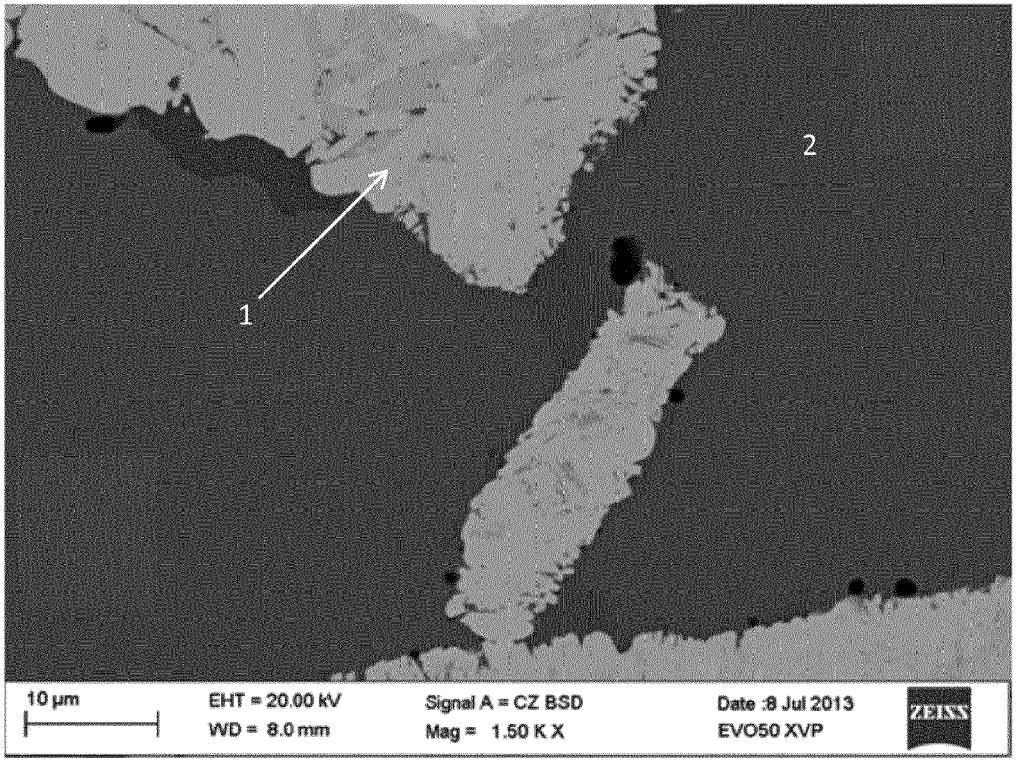
FIG. 3: A SEM image in 1.50K× magnification of an MMC material according to a second preferred embodiment.

In the sample IN2 of the second embodiment of the invention shown in FIG. 3, the matrix contains low amounts of carbon and tungsten and is more ductile. Since the matrix is ductile it absorbs the stress that is formed at the tungsten carbide particles and therefore no cracks are formed.

The invention claimed is:

1. A method for manufacturing a wear resistant component, comprising the steps of:

providing a mould defining at least a portion of the component;

providing a powder mixture including a first powder of tungsten carbide particles (WC) and a second powder of a cobalt-based alloy, wherein the powder mixture comprises 30-70 vol % of the first powder of tungsten carbide particles (WC) and 70-30 vol % of the second powder of the cobalt-based alloy and the second powder of cobalt-based alloy comprises 20-35 wt % Cr, 0-20 wt % W, 0-15 wt % Mo, 0-10 wt % Fe, 0.05-4 wt % C and balance Co, wherein the amounts of W and Mo fulfill the requirement $4<W+Mo<20$;

filling the mould with the powder mixture; and subjecting the mould to Hot Isostatic Pressing (HIP) at a predetermined temperature, a predetermined isostatic pressure and for a predetermined time so that the particles of the powder mixture bond metallurgically to each other, wherein particles in the powder mixture have a size in a range of 50-250 μm and a mean size of particles of the second powder of cobalt-based alloy is less than ⅙ of a mean size of particles of the first powder of tungsten carbide particles (WC), and wherein the predetermined temperature is 70-200° C. below the melting point of the cobalt based alloy and wherein the predetermined isostatic pressure is >500 bar.

2. The method according to claim 1, wherein the cobalt-based alloy comprises 14-16 wt % W.

3. The method according to claim 1, wherein the cobalt-based alloy comprises 27 wt % Cr, 14 wt % W, 0 wt % Mo, 9 wt % Fe, 3.3 wt % C and balance Co.

4. The method according to claim 1, wherein the cobalt-based alloy comprises 27-31 wt % Cr, 13-16 wt % Mo, 0 wt % W, 0-10 wt % Fe, 3.2-3.5 wt % C and balance Co.

5. The method according to claim 1, wherein the amounts of W and Mo fulfill the requirement 5<W+Mo<20.

6. The method according to claim 1, wherein the cobalt-based alloy comprises 26-30 wt % Cr, 4-8 wt % Mo, 0-8 wt % W, 0-1.7 wt % C and balance Co.

7. The method according to claim 6, wherein the cobalt based alloy comprises 26-29 wt % Cr, 4.5-6 wt % Mo, 0.25-0.35 wt % C and balance Co.

8. The method according to claim 7, wherein the amounts of W and Mo fulfill the requirement 4<W+Mo<16.

9. The method according to claim 6, wherein the amounts of W and Mo fulfill the requirement 4<W+Mo<16.

10. The method according to claim 1, wherein the predetermined time is 1-5 hours.

11. The method according to claim 1, wherein the predetermined temperature is 100-150° C. below the melting point of the cobalt based alloy.

12. The method according to claim 1, wherein the predetermined time is 1-3 hours.

13. The method of claim 1, wherein the first powder and the second powder of the powder mixture have been blended to a homogenous powder mixture prior to filling the mould.

14. The method of claim 1, wherein at least a portion of the component has an isotropic microstructure and comprises carbides in sizes from 1-4 μm dispersed in a matrix of cobalt based alloy.

15. The method of claim 1, wherein the manufactured wear component has isotropic microstructure and isotropic properties.

16. The method of claim 1, wherein tungsten carbide particles of the first powder are spherical shaped.

17. The method of claim 1, wherein tungsten carbide particles of the first powder are facetted shaped.

18. The method according to claim 1, wherein the predetermined isostatic pressure is 900-1200 bar.

19. The method of claim 1, wherein the predetermined temperature is 100-200 ° C. below the melting point of the cobalt based alloy.

20. A method for manufacturing a wear resistant component, comprising the steps of:

providing a mould defining at least a portion of the component;

providing a powder mixture including a first powder of tungsten carbide particles (WC) and a second powder of a cobalt-based alloy;

filling the mould with the powder mixture; and subjecting the mould to Hot Isostatic Pressing (HIP) at a predetermined temperature, a predetermined isostatic pressure and for a predetermined time so that the particles of the powder mixture bond metallurgically to each other, wherein the powder mixture has 30 vol % of the first powder of tungsten carbide particles (WC) and 70 vol % of the second powder of cobalt-based alloy wherein the second powder of cobalt-based alloy comprises 20-35 wt % Cr, 0-20 wt % W, 0-15 wt % Mo, 0-10 wt % Fe, 0.05-4 wt % C and balance Co, and the amounts of W and Mo fulfill the requirement 4<W+Mo<20, wherein particle sizes for the first powder of tungsten carbide particles (WC) are 100-200 μm and particle sizes for the second powder of cobalt-based alloy are 45-95 μm, and wherein the predetermined temperature is 70-200° C. below the melting point of the cobalt based alloy and wherein the predetermined isostatic pressure is >500 bar.

21. The method according to claim 20, wherein the cobalt-based alloy comprises 14-16 wt% W.

22. The method according to claim 20, wherein the cobalt-based alloy comprises 27 wt% Cr, 14 wt% W, 0 wt% Mo, 9 wt% Fe, 3.3 wt% C and balance Co.

23. The method according to claim 20, wherein the cobalt-based alloy comprises 27-31 wt% Cr, 13-16 wt% Mo, 0 wt% W, 0-10 wt% Fe, 3.2-3.5 wt% C and balance Co.

24. The method according to claim 20, wherein the amounts of W and Mo fulfill the requirement 5 <W+Mo <20.

25. The method according to claim 20, wherein the cobalt-based alloy comprises 26-30 wt% Cr, 4-8wt% Mo, 0-8 wt% W, 0-1.7 wt% C and balance Co.

26. The method according to claim 25, wherein the cobalt based alloy comprises 26-29 wt% Cr, 4.5-6 wt% Mo, 0.25-0.35 wt% C and balance Co.

27. The method according to claim 26, wherein the amounts of W and Mo fulfill the requirement 4 <W+Mo <16.

28. The method according to claim 25, wherein the amounts of W and Mo fulfill the requirement 4 <W+Mo <16.

29. The method according to claim 20, wherein the predetermined time is 1-5 hours.

30. The method according to claim 20, wherein the predetermined temperature is 100-150 ° C. below the melting point of the cobalt based alloy.

31. The method according to claim 20, wherein the predetermined time is 1-3 hours.

32. The method according to claim 20, wherein the predetermined isostatic pressure is 900-1200 bar.

33. The method of claim 20, wherein the predetermined temperature is 100- 200 ° C. below the melting point of the cobalt based alloy.

34. The method of claim 20, wherein the first powder and the second powder of the powder mixture have been blended to a homogenous powder mixture prior to filling the mould.

35. The method of claim 20, wherein at least a portion of the component has an isotropic microstructure and comprises carbides in sizes from 1-4 μm dispersed in a matrix of cobalt based alloy.

36. The method of claim 20, wherein the manufactured wear component has isotropic microstructure and isotropic properties.

37. The method of claim 20, wherein tungsten carbide particles of the first powder are spherical shaped.

38. The method of claim 20, wherein tungsten carbide particles of the first powder are facetted shaped.

* * * * *